US005255584A

United States Patent [19]

Fakler

[11] Patent Number: 5,255,584

[45] Date of Patent: Oct. 26, 1993

[54] DEVICE FOR CUTTING AND STACKING OF PRODUCTS PACKED IN A FOIL TUBE

[75] Inventor: Eugen Fakler, Laupheim, Fed. Rep. of Germany

[73] Assignee: Natec, Reich, Summer GmbH & Co. KG, Fed. Rep. of Germany

[21] Appl. No.: 848,085

[22] Filed: Mar. 9, 1992

[30] Foreign Application Priority Data

Feb. 19, 1992 [DE] Fed. Rep. of Germany ..... 4204987

[51] Int. Cl.[5] ..... B65B 61/06; B65B 35/50; B65G 57/14

[52] U.S. Cl. ..... 83/94; 83/90; 83/155.1; 414/790; 414/790.1; 53/535; 53/544

[58] Field of Search ..... 53/446, 447, 154, 535, 53/540, 544, 143; 414/790, 790.1, 791, 794, 794.2, 793.7, 788.3, 791.3; 83/29, 32, 90, 94, 155.1

[56] References Cited

U.S. PATENT DOCUMENTS

| | | | |
|---|---|---|---|
| 2,010,732 | 8/1935 | Mandusic | 271/88 |
| 3,107,793 | 10/1963 | Frank | 414/791 |
| 3,591,018 | 7/1971 | Nalbach | 414/793.7 X |
| 3,866,763 | 2/1975 | Alduk | 414/790.1 |
| 4,042,125 | 8/1977 | Falkinger et al. | 414/790.1 |
| 4,460,169 | 7/1984 | Bartesaghi | 271/192 |
| 4,570,418 | 2/1986 | Gino | 53/520 X |
| 4,599,025 | 7/1986 | Borsuk et al. | 414/82 |
| 4,683,708 | 8/1987 | Linder | 53/540 |
| 4,712,361 | 12/1987 | Oberoi | 53/540 |
| 4,867,626 | 9/1989 | Oberoi | 414/793.7 |
| 4,902,184 | 2/1990 | Fritz | 53/540 X |
| 5,114,307 | 5/1992 | Meli et al. | 414/793.1 |

FOREIGN PATENT DOCUMENTS

| | | |
|---|---|---|
| 0439438 | 7/1991 | European Pat. Off. . |
| 214321 | 3/1909 | Fed. Rep. of Germany . |
| 7238191 | 1/1973 | Fed. Rep. of Germany . |
| 2302477 | 7/1974 | Fed. Rep. of Germany . |
| 2758979 | 7/1979 | Fed. Rep. of Germany . |
| 381684 | 11/1986 | Fed. Rep. of Germany . |
| 3736868 | 11/1989 | Fed. Rep. of Germany . |
| 472319 | 6/1969 | Switzerland . |
| 21665203 | 4/1986 | United Kingdom . |

*Primary Examiner*—Horace M. Culver
*Attorney, Agent, or Firm*—Brown, Martin, Haller & McClain

[57] ABSTRACT

The device for cutting and stacking products is based upon product slices which are packed in the form of a chain in a foil tube whereby the individual product slices are separated from one another by sealing seams which run perpendicular to the width of the foil tube. The cutting device cuts the individual interlinked product slices in the area of the sealing seam and the cut product slices are placed onto a stacking device in which product stacks are built which are taken to a subsequent packing machine. At the exit of the cutting device is a stacking chamber of which two vertical opposing walls are formed by two belts having spaced fins or projections which form take-up spaces into which the product slices can be introduced.

8 Claims, 2 Drawing Sheets

DEVICE FOR CUTTING AND STACKING OF PRODUCTS PACKED IN A FOIL TUBE

BACKGROUND OF THE INVENTION

The present invention is a cutting and stacking unit for cutting a sealed foil tube containing a series of product slices into separate, individual product slices or packages and stacking the slices vertically for subsequent packaging purposes.

A cutting and stacking unit of the type mentioned above is already known in that it features a foil tube in which individual product sections are divided by sealing seams and interlinked. The sealed foil tube is taken up on a distributor roller and aspirated by under-pressure. In other words, the foil tube is placed radially at the periphery of the distributor roller. A cutting device is then activated in the longitudinal direction to the distributor roller and separates successively the coherent packing units. After separation, the product packages are distributed over a total of three parallel tracks by means of a mechanical sliding unit which operates in the direction of the longitudinal axis of the distributor roller. The product slices arranged in tracks over the periphery are then dropped onto a lower guide way.

Accordingly, the described cutting and stacking unit has the disadvantage that the division into parallel guide ways requires substantial machinery when uniform, continuously sealed foil tube is involved. The cutting device arranged in the rotating distributor roller is relatively "involved" as well as the necessary sliding device which moves the individual cut product packages in different guide ways arranged parallel in reciprocal distance on the outer periphery of the distributor roller.

In addition, there is the disadvantage that when the product slices are dropped from the distributor roller onto the lower guide way, a uniform trajectory cannot always be ensured which may cause the product slices after dropping onto the lower guide way to tilt or slant thus making the subsequent stack formation for transport to the packing machine difficult.

Such a known distribution arrangement operates only with a maximum capacity of about 150 packages per track and per minute whereby there is also the danger that product packages may be damaged during their free fall when they are dropped.

In addition, the drop geometry of the packing units dropped off by the roller depend upon the speed of rotation of the roller. This means that at the start-up of the known cutting and stacking unit a drop geometry must be accepted which is different from that in effect when the operating speed is reached, which once gain makes the formation of stacks in the following packing machine difficult.

SUMMARY OF THE INVENTION

The underlying task of the present invention is therefore to further develop a cutting and stacking unit of the type named above which ensures a reliable stack formation of the individual packages with lower production costs and lower maintenance and repair. According to the present invention, a cutting and stacking apparatus is provided in which a stacking unit is arranged underneath a cutting device. The stacking unit consists in essence of a vertical stacking chamber of which at least two vertical opposite walls are formed by two endless conveyor belts each having a series of spaced projecting lamellae or fins between which the opposite side edges of individual slices or packages can be retained.

The technology of the present invention realizes the essential advantage that the product slices cut by the cutting device no longer fall uncontrolled in a free fall onto a deposit surface but rather that these product slices reach the contact zone of two opposing conveyor belts equipped with fins projecting outwardly from the outer outer surface of the belts. The product slices then are engaged in the intermediate area between these fins and are carefully deposited and stacked onto a support by the moved-down lamella belts.

This offers the distinct advantage that a free fall of the cut product slices is prevented and that a neat stack with straight boundary edges is formed by the controlled deposit of these product slices onto a deposit surface.

In a first embodiment of the present invention, the conveyor belt is designed as a brush belt, i.e. radially outward brushes are arranged on a revolving endless belt and form take-up spaces between them whereby each take-up space on the one belt side lies across from a similar take-up space room on the other belt side. In each take-up space one side of the product slice is taken up while the other side is taken up by the opposing take up space on the other belt. The slice is carefully carried downward in the stack chamber in the direction of a support surface.

The philosophy of the present invention also applies to other designs in addition to the design described here of the conveyor belt as a brush belt.

The fins or lamellae mentioned previously may be designed as rubber fins or lamellae or rubber fins which form the take-up space between them as described above.

It is also possible to use other elastic or resilient elements such as spiral springs of metal or synthetic and such.

A further development of the present invention uses rigid hinged flaps which are attached and hinged on the belt side so that they form an even deposit surface with take-up spaces above and below when the belt travels down while these hinged flaps flap up when they encounter an obstacle.

A further increase in stacking speed may be obtained by stacking the individual product slices arranged in the stacking chamber at a short distance vertically over each other and parallel and carried down by the lamella belts not on a single deposit surface but rather that there is a so-called intermediate support prior to this final deposit surface. A first product stack is formed on this intermediate support until a certain stack height has been reached.

This creates an intermediate buffer which makes it possible to deposit the main stack formed below onto a supply belt and to empty this main stack while filling the intermediate stack on the intermediate support.

Another essential characteristic of the invention is that during the cutting process the product slices are held in assigned guide ways in order to prevent sagging or bending of these product slices during the cutting process.

In addition, purpose of the guide ways is to ensure that a controlled slide movement into the cutting device is guaranteed when the product-filled and sealed foil tube drives into the cutting and stacking device for the first time.

The guide limitation is up and to the side in order to avoid an non-permissible bending and swerving of the front side of the foil tube.

Another essential feature is that when the cutting process is complete the guide ways are taken out of contact or out of reach of the stacking chamber in order to enable a holding device behind the cutting knife to enter the stacking chamber and to bring the just-cut product slices within reach of the juxtaposed belts. In other words, this holding device, which operates in an oscillating manner, presses a product slice into the opposing take-up spaces of the opposing belts and travels up again while the product slice remains in the take-up space and travels together with the two parallel belts down in the stacking tray until the intermediate support.

A further improvement in stacking accuracy is brought by vertical guide ways in the stacking tray which work together with corresponding stop faces on the product slices and take these product slices down in the stacking tray without tilting.

BRIEF DESCRIPTION OF THE DRAWINGS

The following is a more detailed description of the invention through drawings which illustrate only one variant. The drawings and their description disclose additional essential characteristics and advantages of the invention.

DESCRIPTION OF THE PREFERRED EMBODIMENT

In the cutting and stacking unit 12, the individual sealed sections are cut in the respective foil tube and the two different packing units from the separate foil tubes are stacked in one stacking unit or chamber after they were cut by the cutting device 32. The product stacks are then formed in the stacking chamber and taken to a packing station by a conveyor 23, 24.

Figure 1:
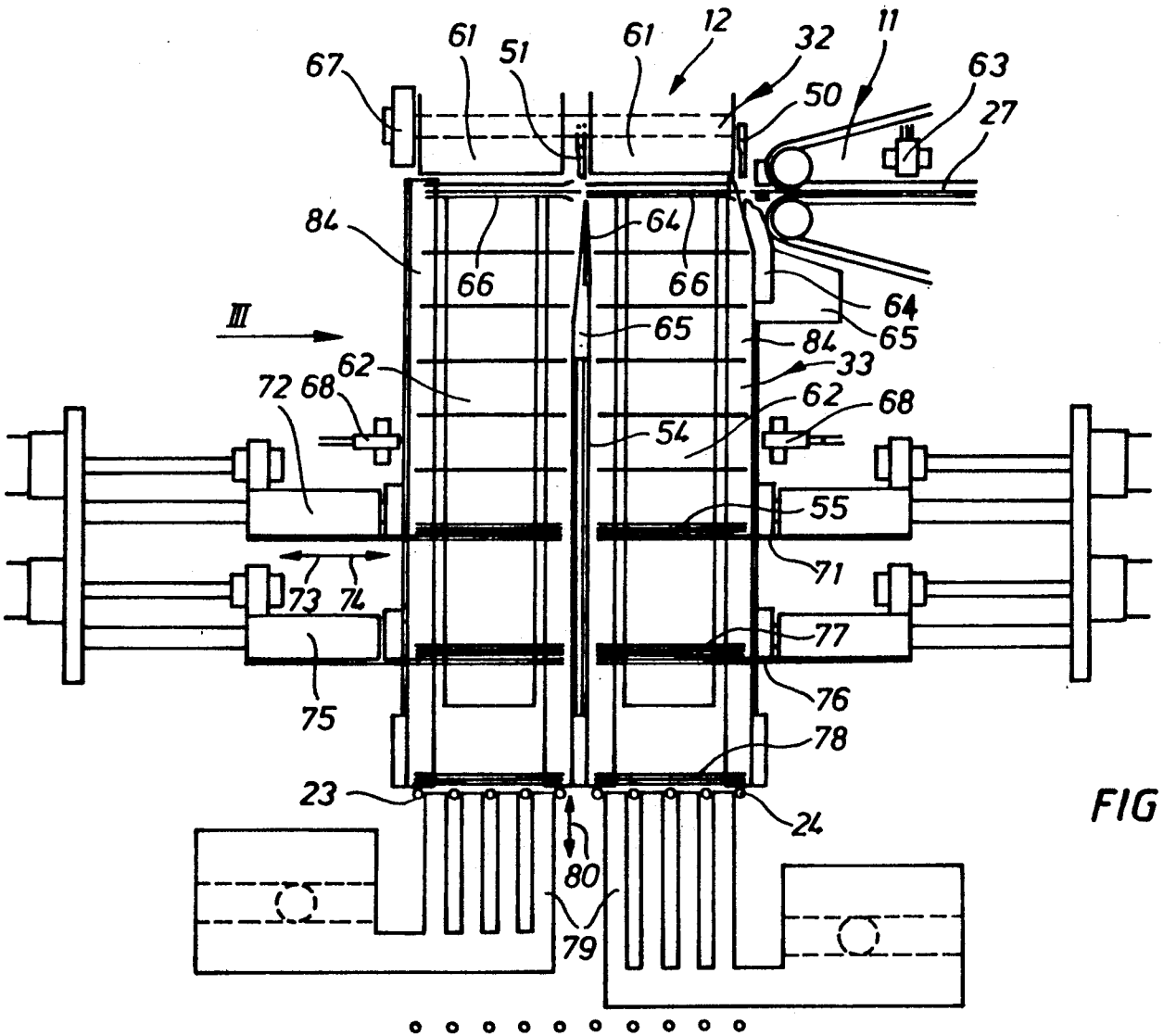
FIG. 1 is a lateral view of a cutting and stacking device in accordance with the invention in the direction of arrow II in FIG. 2.

In accordance with FIG. 1, the foil tube 27 is fed into cutting and stacking unit 12 via a timed foil transport station 11*a, b*.

Figure 2:
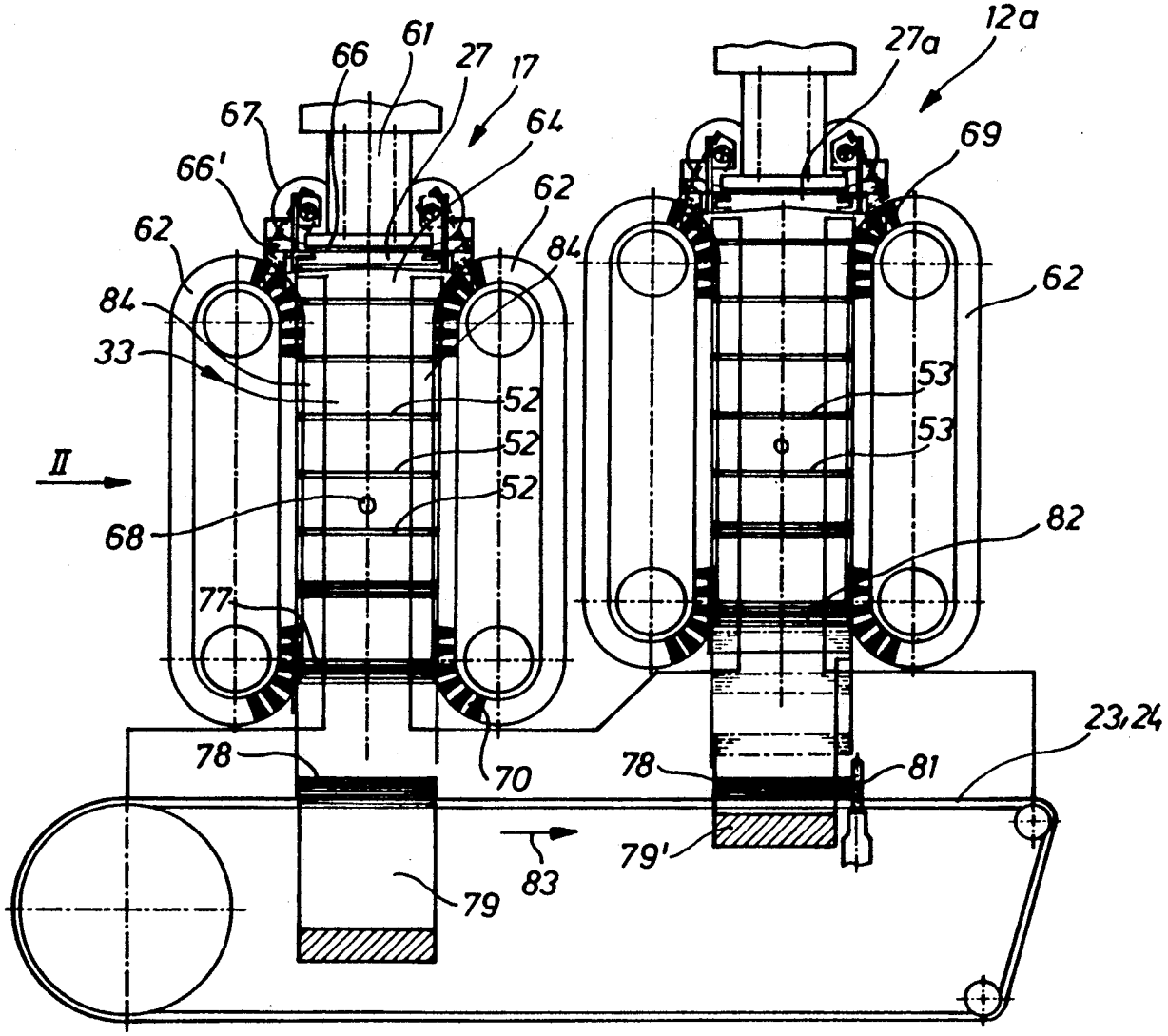
FIG. 2 is a lateral view of the cutting and stacking device in the direction of arrow III in FIG. 1.

The intake side features a sensor 63 which detects a sealing seam which runs perpendicular to the drawing plane of FIG. 2 and indicates the feeding length for the foil transport station. As soon as the sealed foil tube 27, 27*a*, on which the individual product slices hang together in the form of a chain and are not yet separated, is entered into the cutting and stacking unit in accordance with FIG. 2, the knives 50, 51 of the cutting device 33 are activated and make the cut in the area of a sealing seam.

In accordance with FIG. 2 the knives are connected to an upper holding device 61 whereby the knives 50, 51 work together with a counter-knife 64 which is attached to a mount 65.

When sliding the foil tube 27 into the cutting and stacking unit 12, guide ways 66 take up the foil tube between them whereby the guide ways in the direction of slide-in are expanded conically in order to allow for a smooth introduction of the foil tube into the guide way 66.

When cutting is complete, each guide way contains a cut product slice 52, 53.

Inasmuch as the design of the cutting and stacking units 12, 12*a* is exactly identical, it suffices for the following description to describe only one cutting and stacking unit 12 or 12*a*.

In order to drive the cut product slices 52, 53 in the area of the lateral conveyor belts 62, the holding device 61 travels down whereby at the same time the guide ways 66 are rotated outward in their position 66' in accordance with FIG. 2 by a corresponding deflection device 67.

As a result, the holding device 61 is able to travel down in the direction of arrow 80 and transport a cut product slice 52, 53 into the area of revolving endless conveyor belts 62.

Each conveyor belt 62 consists of an endless belt with radial lamella or fins 69 which define take-up spaces 70 between adjacent fins 69.

The cut product slice 52, 53 is introduced in such a take-up space by opposing conveyor belts 62 and is held in a force-locking manner.

When driving the holding device 61 with attached knives 50, 51 back up in the direction of arrow 80 the guide ways are at the same time returned from their position 66' to their position 66 through the deflection device 67 and are ready to take up a new section of the foil tube 27.

The product slices 52, 53 now move down in the stacking chamber 33 whereby vertical lateral stops for the guide ways 84 prevent a tilting or shift of these product slices in the stack chamber 33.

Product slices are first placed on an intermediate support 71 located roughly in the lower third of the stacking chamber. They form a first product stack 55.

Inasmuch as two product slices are cut by the cutting and stacking unit 12 and 12*a* respectively, there are two stacking chambers 33 which are identical overall so that it suffices to describe only half of a cutting and stacking unit, i.e. the left or right part of the stacking tray 33.

The product stack 55 forming on the intermediate support 71 fills from bottom to top until a certain stack height is reached as determined by a corresponding counter 68.

As soon as the preset stack height has been reached, the intermediate support 71 is moved left in the direction of arrow 73 by a corresponding moving device 72 whereby the deposit surface for the product stack 55 is removed from the stack unit 33 and the product stack makes contact again with the fins or projections of the belt 62 and is placed carefully down onto a stack deposit 76 where a product stack 77 is formed.

It is important to note that the fins of the belts 62 do not catch the product stack 55 on the intermediate support 71 because the width of the intermediate support 71 is slightly greater than the width of the product stack 55 so that the fins are deviated at the intermediate support 71 and do not make contact with the front sides of the product stack 55.

After the formation of the lower product stack 77 on which the upper product stack 55 is stacked, the upper intermediate support 71 is closed once again by activating the moving device 72 in the direction of arrow 74 whereby the stacking chamber in the area of the upper intermediate support 71 is available once again for further stacking of a product.

As soon as the lower product stack 77 is full, a rack-shaped collector 79 is driven up and the upper product stack 77 is placed onto the upper tips of the collector 79 by pulling the moving device 75 in the direction of arrow 73.

The collector 79 then drives down in the direction of arrow 80 and places the product stack onto a conveyor 23, 24.

The collector 79 is rack-shaped and enters through the conveyors 23, 24 formed by shutter cords.

The drawing in accordance with FIG. 2 shows the collector 79 left in its lower lowered position while it is shown in FIG. 2 to the right in its position 79' in raised position. The left representation is the deposit position and the right representation is the collect position.

In other words, a product stack 78 is formed on the respective conveyor 23, 24, and FIG. 2 shows that with two subsequent cutting and stacking units 12, 12*a* a mixture of the product stacks 78 takes place on the conveyors.

The product stack 78 placed left on the conveyor in the drawing of FIG. 2 is moved in the direction of arrow 83 to the area of the stacking chamber of the right cutting and stacking unit 12*a*. It reaches a stop 81 and is stopped. As a result, the stack 78 is raised up by the collector 79 until it rests at the bottom of an upper product stack 82. Then the stack deposit 76 opens whereby the product stack 82 is placed onto the lower product stack 78 and forms a combined product stack which is placed onto the conveyor 23, 24 by driving down the collector in the direction of arrow 80. The succession of two stacking units 12, 12*a* enables the mixture of product stacks on two different conveyors 23, 24.

The stop 81 is then lowered and the combined product stack is moved by the conveyors 23, 24 in the direction of arrow 83 and taken into the take-in area of a packing machine. Depending upon packing machine, it is possible to carry these ready stacks in one or two tracks.

The implementation of the technology in accordance with the invention offers the distinct advantage that together with significantly improved stacking performance any damaging of packed product slices is prevented with certainty, and that the previously mentioned free fall which adversely affected the drop geometry is prevented in accordance with the invention. The result is a careful guided placing of product slices for the purpose of building a stack, and the stacks themselves are also carefully placed onto assigned conveyors 23, 24 by the previously mentioned belts together with vertical collectors which can be raised and lowered.

I claim:

1. A cutting and stacking apparatus for cutting a foil tube of individual product slices separated by transverse sealing seams along the seams to form separate product slices and stacking the slices vertically, comprising:

a cutting device comprising means for cutting the tube in a cutting direction through the sealing seams to form individual slices;

feed means for feeding the tube in a horizontal feeding direction into the cutting device;

a vertical stacking unit for stacking the cut slices, the stacking unit having an open upper end adjacent an outlet of said cutting device, and a pair of spaced vertical side walls, each side wall comprising an endless conveyor belt having a series of spaced, outwardly projecting fins with a take-up space between each adjacent pair of fins, the fins on one belt opposing the fins on the opposite belt, and each pair of adjacent fins on each belt comprising means for retaining one side edge of a product slice in the take-up space between the fins while the opposite side edge is taken up in the opposing space between an opposing pair of fins on the other belt, each belt having a downward run opposing the downward run of the other belt for conveying slices downwardly from the upper end of the stacking unit, each downward run having an upper end and a lower end;

guide means at the open upper end of the stacking unit for laterally guiding a slice in a horizontal orientation into the stacking unit;

an intermediate support located between the conveyor belts at a location intermediate the upper and lower ends of the downward run of belts, the intermediate support comprising means for releasably supporting an intermediate stack of slices; and a hold down device above the open upper end of said stacking unit, the hold down device being movable in a direction parallel to said cutting direction into said open upper end and comprising means for moving a cut product slice into the stacking unit for take up in the take-up spaces of opposed pairs of fins on the conveyor belts.

2. The apparatus as claimed in claim 1, including deflection means for moving the guide means between an extended position above the open upper end of the stacking unit and a retracted position spaced from the open upper end of the stacking unit to release a slice into the stacking unit.

3. The apparatus as claimed in claim 2, wherein the deflection means comprises means for rotating the guide means about a horizontal axis at the cutting means.

4. The apparatus as claimed in claim 1, wherein the intermediate support comprises a plate, and drive means for moving the plate in a horizontal direction perpendicular to the direction of transport of the belts and transverse to the gap between the belts between an extended position in the gap between the belts for receiving slices to be stacked and a retracted position spaced to one side of the belts for allowing an intermediate stack of slices formed on the plate to be taken up by the belts.

5. The apparatus as claimed in claim 1, including at least one additional intermediate support spaced from the first-mentioned intermediate support.

6. Apparatus for cutting an elongate member into individual product slices and stacking the slices into a vertical stack, comprising:

cutting means for cutting the member into individual slices in a transverse cutting direction, the cutting means having in inlet end and an outlet end;

feed means for feeding the elongate member in a horizontal cutting plane through the cutting means;

a stacking unit at the outlet end of the cutting means having an open upper end and at least two spaced side walls defining a vertical stacking chamber having an open lower end, the stacking unit being positioned below the cutting plane;

the spaced side walls comprising a pair of opposing conveyor belts, each belt having a plurality of spaced, outwardly projecting fins along its length, each adjacent pair of fins on each belt comprising means for retaining one side edge of at least one cut slice in the space between said fins while the opposite side edge is retained between the opposing pair of fins on the other belt;

drive means for driving the conveyor belts in a conveying direction for conveying slices held between opposing pairs of fins downwardly in a conveying path having an upper end and a lower end; and an intermediate support located between the belts in said conveying path at a location intermediate the upper and lower ends of said conveying path, and drive means for driving the intermediate support between an extended position at a fixed height in the stacking chamber between the opposing belts and a retracted position outside the stacking chamber, the intermediate support comprising means for forming an intermediate stack of slices in the extended position.

7. The apparatus as claimed in claim 6, including retractable guide means above the open upper end of the stacking chamber for receiving a cut slice from the cutting unit and supporting the cut slice horizontally above the stacking chamber, the guide means being movable between an extended position above the stacking chamber and a retracted position for releasing a slice into the stacking chamber.

8. The apparatus as claimed in claim 6, including hold down means positioned above the open upper end of the stacking chamber, the hold down means comprising a hold down device and drive means for moving the hold down device downwardly in the conveying direction into the open upper end of the stacking chamber to move cut slices into the area of the take up spaces of the conveyor belts.

* * * * *